US006916766B2

(12) United States Patent
Buzdygon et al.

(10) Patent No.: US 6,916,766 B2
(45) Date of Patent: Jul. 12, 2005

(54) CIRCULATING OIL COMPOSITIONS

(75) Inventors: Kevin Buzdygon, Wilmington, DE (US); Angela Stefana Galiano-Roth, Mullica Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 11 days.

(21) Appl. No.: 10/353,109

(22) Filed: Jan. 28, 2003

(65) Prior Publication Data

US 2003/0191031 A1 Oct. 9, 2003

Related U.S. Application Data

(60) Provisional application No. 60/354,417, filed on Feb. 5, 2002.

(51) Int. Cl.[7] ..... C10M 141/06; C10M 141/12

(52) U.S. Cl. ..... 508/192; 508/222; 508/306; 508/548; 508/579

(58) Field of Search ..... 508/306, 579, 508/192, 222

(56) References Cited

U.S. PATENT DOCUMENTS

| | | | | | |
|---|---|---|---|---|---|
| 4,501,616 | A | * | 2/1985 | Fink et al. | 106/38.22 |
| 4,793,939 | A | * | 12/1988 | Mori et al. | 508/579 |
| 4,865,647 | A | * | 9/1989 | John et al. | 106/14.15 |
| 5,219,481 | A | * | 6/1993 | Lawson | 508/548 |
| 5,316,696 | A | * | 5/1994 | Tury | 252/394 |
| 5,559,087 | A | * | 9/1996 | Halsrud et al. | 508/579 |
| 6,001,780 | A | * | 12/1999 | Ho et al. | 508/192 |
| 6,255,263 | B1 | * | 7/2001 | Ryan | 508/579 |
| 6,465,399 | B2 | * | 10/2002 | Koishikawa et al. | 508/416 |

* cited by examiner

*Primary Examiner*—Ellen M McAvoy
(74) *Attorney, Agent, or Firm*—Joseph J. Dvorak

(57) ABSTRACT

A combination of an ashless dispersant comprising the reaction product of a succinic anhydride and a polyamine and an ashless rust inhibitor comprising a mixture of a succinic anhydride and a oxime substituted aromatic compound in a lubricant base stock along with a poly alkylene alcohol demulsifier provides a circulating oil composition having good demulsibility, deposit control and rust inhibition.

12 Claims, No Drawings

CIRCULATING OIL COMPOSITIONS

This application claims the benefit of U.S. Provisional Application(s) No(s).: 60/354,417 filed on Feb. 5, 2002.

FIELD OF THE INVENTION

The present invention relates to lubricating compositions for industrial machinery and more specifically to circulating oil compositions.

BACKGROUND

The art of formulating lubricating oil compositions for industrial equipment has become more complex as a result of increased government and user environmental standards and increased user performance requirements. For example, many end users seek lubricants that do not employ metallic detergents and dispersants that are typically used to keep deposit-forming precursors in an oil away from working surfaces. Ashless or non-metal containing dispersants and detergents, however, tend to be effective in emulsifying water in the oil. Industrial oils such as gear, hydraulic, and circulating oils typically are required to be capable of separating from water in order that any water contamination arising during use does not adversely impact equipment operation and durability. Thus, additives that may enhance one property of a lubricating composition may adversely effect another property.

Another required property for industrial oils is rust inhibition. Again, some end users desire lubricant compositions that employ ashless rust inhibitors. Unfortunately, experience has shown that lubricants with ashless rust inhibitors are not as effective in inhibiting rust as lubricants using metallic sulfonate or metallic carbonate rust inhibitors. Thus use of an additive that may be environmentally desirable may result in a lubricating composition that does not meet certain specific performance requirements.

One object of the present invention is to provide an ashless industrial oil lubricating composition that has good water separability characteristics.

Another object is to provide an ashless lubricating composition that has good rust inhibition.

Yet another object is to provide an industrial oil composition that has good thermal and oxidative stability.

SUMMARY OF THE INVENTION

It has now been found that the combination of an ashless dispersant comprising the reaction product of a succinic anhydride and a polyamine and an ashless rust inhibitor comprising a mixture of a succinic anhydride and an aromatic oxime in a lubricant basestock along with a polyoxyalkylene alcohol demulsifier provides a composition having good demulsibility, deposit control and rust inhibition. Accordingly, in one embodiment, a lubricant composition is provided comprising:

(a) a lubricating oil basestock;

(b) an effective amount of an ashless dispersant comprising the reaction product of a polyalkenyl substituted succinic anhydride and a polyamine;

(c) an effective amount of an ashless rust inhibitor comprising a mixture of a alkyl succinic anhydride and an aromatic oxime; and (d) an effective amount of a demulsifier comprising a polyoxyalkylene alcohol.

Other embodiments of the invention will become apparent from the detailed description which follows.

DETAILED DESCRIPTION OF THE INVENTION

The lubricating oil basestock comprises a major portion of the composition of the present invention and typically will be selected from any of the natural mineral oils of API Group I basestocks. Preferably, the basestock will comprise a mixture of Group I basestock of different viscosities which will be combined in proportions sufficient to meet a predetermined viscosity requirement. For example, a suitable basestock for a paper machine oil comprises a mixture of from about 20 to 80 wt % of a 2500 solvent neutral mineral oil and 600 solvent neutral mineral oil. The basestock can also comprise API Group II, Group III or Group IV basestocks or mixtures of any of Group I, Group II, Group III and Group IV basestocks.

The lubricating oil compositions of the invention includes an effective amount of a succinimide comprising the reaction product of polyalkenyl substituted succinic anhydride and a polyamine. Typically, the polyalkenyl group of the succinic anhydride will be selected from ethylene, propylene, butylene, isobutylene and pentene and preferably is a polyisobutylene group of from about 500 to about 2500 Mn and more preferably from about 900 to about 1000 Mn. Thus, the preferred polyalkenyl succinic acid anhydride is polyisobutylene succinic anhydride (PIBSA).

Among suitable polyamines used in forming the succinimide mention is made of ethylenediamine (EDA), diethylenetriaminime (DETA), triethylenetetramine (TETA) and tetraethylenepentamine (TEPA). Particularly preferred is TEPA. Thus, the preferred dispersant is PIBSA TEPA.

The method for reacting a polyalkenyl succinic anhydride with a polyamine is well known in the art. In general, the molar ratio of polyamine to polyalkenyl succinic anhydride is in the range of about 0.35:1 to about 1:1.

Preferably the reaction product is subjected to a postcure with cyclic carbonate, boric acid or a boric acid derivative. Postcure techniques are known in the art. In this regard see, for example, U.S. Pat. No. 4,612,132 which is incorporated herein by reference.

In general, the amount of dispersant will constitute from about 0.1 to about 5.0 wt % of the total weight of the composition and preferably from 0.2 to 2.0 wt %.

The lubricating oil composition of the invention, also includes an effective amount of a mixture of an alkyl substituted succinic anhydride and an oxime substituted aromatic compound. The alkyl substituted succinic anhydride may be represented by the formula

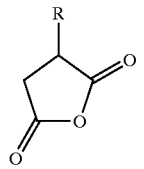

where R is a linear or branched alkyl group of from about 8 to about 20 carbon atoms. Preferably R is a branched alkyl group of from 12 to 14 carbon atoms.

The oxime substituted aromatic compound may be represented by the formula

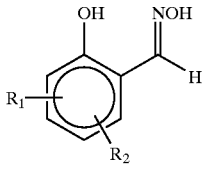

where $R_1$ is H or

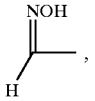

and $R_2$ is an alkyl group of from 5 to 15 carbon atoms.

Typically, molar ratio of alkyl substituted succinic anhydride to aromatic oxime will be in the range of about 1:1 to about 10:1 and preferably about 2:1 to about 4:1.

The amount of the ashless rust inhibitor employed typically will be in the range of from about 0.1 to about 3.0 wt %, and preferably from 0.2 to 1.5 wt % based on the total weight of the composition.

The lubricant composition of the invention also includes an effective amount of a polyoxyalkylene alcohol demulsifying agent. A particularly suitable polyoxyalkylene alcohol demulsifying agent is characterized by the formula

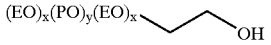

where EO is an ethylene oxide moiety, PO an propylene oxide moiety and x and y represent the relative amounts of each. A preferred demulsifying agent will have a Mn in the range of about 1700 to 3000 and an EO/PO ratio of from about 20:80 to about 1:99. Typically, the polyoxyalkylene alcohol demulsifying agent is dissolved in a solvent such as tricresyl phosphate (TCP). Especially useful is a solution comprising from 75 to 99 wt % TCP.

In general, the demulsifying agent will be used in an amount ranging from about 0.001 to about 0.1 wt % based on the total weight of the composition.

Optionally, the composition may also include one of the various types of lubricant thickeners well known in the art. An example of one such thickener is polyisobutylene. Thus, in one embodiment the composition of the invention may include 0 wt % up to about 25 wt % of a thickener.

Other conventional additives which may be used in the lubricants of this invention include oxidation inhibitors, antiwear agents, metal passivators, antifoam agents and the like.

Examples of antiwear agents, that may be used, include alkylated dithiocarbamates, alkyl phosphates, aryl phosphates, thiophosphates, amine phosphates and dithiophosphates.

The composition may include one or more metal passivators selected from alkylated benzotriazole, tolyltriatole, and dimercaptothiodiazole.

One or more oxidation inhibitors also may be used in the lubricants of this invention including diphenyl amines, phenyl alpha naphthyl amines, and hindered phenolic type.

One or more antifoam agents may be used in the lubricants of this invention, including polydimethylsiloxane and polymethacrylate.

The above mentioned additional additives are used in amounts sufficient to provide their normal function. Typical amounts for individual components in a preferred lubricant composition is given in Table 1.

TABLE 1

| Component | Composition | Broad wt % | Preferred wt % |
|---|---|---|---|
| Base stock | 2500 solvent neutral | 1.0–99 | 20.0 –60.0 |
| | 600 solvent neutral | 1.0–99 | 40.0 –70.0 |
| Ashless dispersant | PIBSA–TEPA | 0.1–5.0 | 0.2 –2.0 |
| Ashless rust inhibitor | Aromatic oxime/alkylated succinic anhydride | 0.1–3.0 | 0.2–1.5 |
| Demulsifier | Ethylene oxide-propylene oxide alcohol | 0.001–0.1 | 0.005–0.05 |
| Anti-wear agent(s) | miscellaneous | 0.1–5.0 | 0.5 –1.5 |
| Metal passivator(s) | miscellaneous | 0.01–1.0 | 0.05–0.20 |
| Thickener | miscellaneous | 0.0–25.0 | 1.0–5.0 |
| Anti foam agent(s) | miscellaneous | 0.0001–0.1 | 0.001–0.01 |

EXAMPLES

The following examples are presented to further illustrate the invention.

Test Procedures

The lubricating compositions set forth in the Tables 2 to 5 were tested according to the following procedures:

Deposit Control

Bearing Rig Test (BRT)

In the BRT test, the oil is circulated through steam heated spherical roller bearings. Water is added periodically to simulate moisture contamination in service. At test completion, the bearing rollers, cage and raceways are rated for deposits using the CRC varnish rating scale.

Property Retention Test (PRT)

In the PRT test, the oil is circulated with a gear pump at moderately high temperature and pressure for 2000 hours. In addition to the temperature and pressure, multimetal catalysts and periodic water contamination are used to simulate oil stress in service. The oil reservoir, the metal catalysts, and an in-line screen mesh filter are observed periodically for deposits. The physical properties of the oil are also measured periodically.

Antiwear

FZG scuffing test, DIN 51354

Rust and Corrosion Protection

Rust test with synthetic sea water, ASTM D665B

Copper strip corrosion test, ASTM D130

SKF Emcor Rust Test, IP 220

Thin Oil Film Inhibition Test, commonly known as the TOFI test.

In the TOFI test, polished steel panels are immersed in test oil and exposed to 100% humidity at 140° F. The test continues until 5% of the steel panel surface is covered with rust. Many oils that pass ASTM D665B will show some rust formation in the TOFI test.

Water Separability

ASTM D1401

ASTM D2711

Filterability

Pall Filtration

AFNOR Filtration, wet and dry methods

Oxidation Stability

RBOT, ASTM D2272 (now called RPVOT)

TOST, ASTM D943

Comparative Example 1

These ashless oil compositions were formulated having the ingredients shown in Table 2. As can be seen, formulation 1 and 2, which include a dispersant, have poor demulsibility, whereas formulation 3, without dispersant has good demulsibility.

TABLE 2

| Component Function | | | Component Description | Formulation 1 | 2 | 3 |
|---|---|---|---|---|---|---|
| base stock | | | 2500 solvent neutral | 35 | 35 | 40 |
| base stock | | | 600 solvent neutral | bal | bal | bal |
| thickener | | | polyisobutylene | 3.8 | 3.8 | 1.8 |
| dispersant | | | ashless borated polyisobutylene-phenol + TEPA (Mannich Base) | 0.5 | | |
| dispersant | | | borated polyisobutylene succinic anhydride reacted with tetraethylpentamine (borated PIBSA-TEPA) | | 0.5 | |
| rust inhibitor | | | ester/amide/carboxylate compound | 0.5 | 0.5 | 0.5 |
| metal passivator | | | alkylated benzotriazole | 0.05 | 0.05 | |
| antiwear | | | amine phosphate | 0.2 | 0.2 | 0.2 |
| antiwear | | | dithiocarbamate | 1 | 1 | 1 |
| antioxidant | | | alkylated diphenylamine amine | 0.15 | 0.15 | 0.15 |
| defoamant | | | dimethylsiloxane polymer | 0.0005 | 0.0005 | 0.0005 |
| demulsifier | | | ethylene oxide propylene oxide polymer diluted 10% in tricresyl phosphate | 0.1 | 0.1 | 0.05 |
| Properties | Tests | | | | | |
| viscosity | ASTM D445 | KV @ 40° C., cSt | | 232.1 | 232 | 219.5 |
| viscosity | ASTM D445 | KV @ 100° C., cSt | | 19.59 | 19.55 | 18.76 |
| VI | | | | 96.2 | 96.0 | 95.3 |
| metals | ASTM D5185 | Metals | Ca, ppm | <2 | <2 | <2 |
| | | | Zn, ppm | <2 | <2 | <2 |
| demulsibility | ASTM D1401 | 180° F. | minutes to 37 ml water | >60 | >60 | 10 |
| | | | minutes to 3 ml emulsion | >60 | >60 | 10 |
| | | | minutes to break | >60 | >60 | 10 |
| demulsibility | ASTM D2711 | | % water in oil | 0.4 | 0.4 | 1 |
| | | | Total free water, ml | 0.2 | 21.5 | 38.2 |
| | | | Emulsion water, ml | 0 | 11.5 | 1.1 |
| | | | Total water, ml | 0.2 | 33 | 39.3 |

TABLE 3

| Component Function | | | Component Description | Formulation 1 | 2 | 3 | 4 | 5 |
|---|---|---|---|---|---|---|---|---|
| Base Stock | | | 2500 solvent neutral | 40 | 40 | 40 | 40 | 40 |
| Base Stock | | | 600 solvent neutral | bal | bal | bal | bal | bal |
| Thickener | | | polyisobutylene | 1.5 | 1.5 | 1.5 | 1.5 | 1.5 |
| Antiwear | | | amine phosphate | 0.2 | 0.1 | 0.1 | 0.1 | 0.1 |
| Dispersant | | | borated polyisobutylene succinic anhydride reacted with tetraethylpentamine (borated PIBSA-TEPA) | 0.5 | 0.5 | | | |
| | | | polyisobutylene succinic anhydride reacted with tetraethylpentamine (PIBSA-TEPA) | | | 0.5 | 0.5 | 0.3 |
| Antiwear | | | dithiocarbamate | 1 | 1 | 1 | 1 | 1 |
| Antioxidant | | | amine | 0.15 | 0.15 | 0.15 | 0.15 | 0.15 |
| Defoamant | | | dimethylsiloxane polymer | 0.05 | 0.05 | 0.03 | | |
| Defoamant | | | polymethacrylate | | | | 0.03 | |
| Demulsifier | | | ethylene oxide propylene oxide polymer diluted 10% in tricresyl phosphate | 0.15 | 0.1 | 0.15 | 0.1 | |
| Rust inhibitor | | | oximine/alkylated succinic anhydride mixture | 0.25 | 0.15 | 0.25 | 0.35 | 0.15 |
| | | blend appearance | | C&B | C&B | C&B | C&B | C&B |
| viscosity | ASTM D445 | KV @40° C. | | 225.3 | | 215.8 | | 218.6 |
| viscosity | ASTM D445 | KV @100° C. | | 19.25 | | 18.69 | | 18.79 |
| VI | ASTM D2270 | Viscosity Index | | 96.5 | | 96.4 | | 95.9 |
| TAN | ASTM D664 | TAN, mg KOH/g | | 0.78 | | 0.38 | | |
| Metals | D5185 | | Ca, ppm | | <2 | <2 | | <2 |
| | | | Zn, ppm | | <2 | <2 | | 2 |
| | | | Final pressure (psi) | | | | | |
| rust | ASTM D665 | ASTM Rust B | | | | pass | | |
| rust | Mobil M1180 | TOFI, hours to 5% rust | | | 648 | 528 | | |

TABLE 3-continued

| Component Function | | | Component Description | Formulation 1 | 2 | 3 | 4 | 5 |
|---|---|---|---|---|---|---|---|---|
| rust | IP220 | SKF Emcor - distilled water | | | | | 0–0, 0–0 | |
| | IP220 | SKF Emcor - acid water | | | | | 1–1+, 0–1 | |
| demulsibility | ASTM D1401 | 180° F. | minutes to 37 ml water | 10 | 10 | 20 | 15 | >60 |
| | | | minutes to 3 ml emulsion | 10 | 10 | 20 | 10 | >60 |
| | | | minutes to break | 10 | 10 | 25 | 15 | >60 |
| demulsibility | ASTM D2711 | (EP Method) | % water in oil | 0.2 | 0.2 | 0.3 | | |
| | | | total free water, ml | 84 | 86 | 86 | | |
| | | | emulsion water, ml | 2.2 | 1.2 | 0.6 | | |
| | | | Total water, ml | 86.2 | 87.2 | 86.6 | | |
| | | | Emulsion, ml | 0.4 | 0 | 0 | | |

As can be seen from Table 2, ashless circulating oil formulations that include a dispersant tend to have poor demulsibility characteristics.

Example 1

Comparative Example 2

Five ashless circulating oil formulations were prepared having the ingredients and properties shown in Table 3. Formulations 1 to 4 are compositions according to this invention while formulation 5 is a comparison (Comparative Example 2) of a composition not having a demulsifier.

As can be seen, formulation 5, which does not contain a demulsifier, displays poor demulsibility characteristics. Also, compositions containing at least 0.3 wt % of the rust inhibitor display good performance in all the rust tests.

Example 3

Multiple, similar ashless circulating oil compositions were prepared having formulations in accord with the invention. The formulation of Table 4 is representative of these formulations.

TABLE 4

| Component Function | Component Description | Amount, wt % |
|---|---|---|
| Base stock | 600 solvent neutral | balance |
| Base stock | 2500 solvent neutral | 39% |
| Rust inhibitor | oxime/alkylated succinic anhydride mixture | 0.30% |
| Dispersant | PIBSA-TEPA | 0.5% |
| Demulsifier | Ethylene oxide Propylene oxide Alcohol in TCP | 0.1% |
| Thickener | polyisobutylene MW 1300 | 20% |
| Antiwear | amine phosphate | 0.1% |
| Antiwear | dithiocarbamate | 1.0% |
| Antioxidant | amine | 0.15% |
| Defoamant | Dimethyl siloxane polymer | 0.0002% |
| Metal passivator | benzotriazole | 0.05% |

Typical properties for a composite of these multiple formulations is given in Table 5.

TABLE 5

| Test Method | General Description | Desired Value | Results |
|---|---|---|---|
| Chemical & Physical Properties | | | |
| ASTM D445 | KV C 40° C., cst | 198–242 | 220 |
| ASTM D445 | KV @ 100° C., cst | 17–21 | 19.0 |
| ASTM D1500 | ASTM Color | <5 | L3.5 |
| ASTM D5185 | Metals by ICP | | |
| | Ca, ppm | <10 | <2 |
| | Zn, ppm | <10 | <2 |
| Filterability | | | |
| Pall Filterability | Dry Pall | Pass | Pass |
| | Volume Filtered (ml) AFNOR Filterability | >2000 | >2000 |
| AFNOR NF 48690 | Dry AFNOR | 2 max | 1.1 |
| AFNOR NF 48691 | Wet AFNOR | 2 max | 1.1 |
| Oxidation Stability & Lube Life | | | |
| ASTM D943 | TOST life, hours | >3000 | 3800 |
| ASTM D2272 | RBOT (minutes) | >300 | 420 |
| Rust & Corrosion | | | |
| ASTM D665 | ASTM Rust B | Pass | Pass |
| ASTM D130 | Copper corrosion 24 hours/100° C. | 2 maximum | 1B |
| | TOFI (Thin Oil Film Inhibition) hours to 5% rust | >200 | 200+ |
| IP 220 | SKF Emcor Rust Test | | |
| | Dist. Water, brg. Rating | 1 maximum | 0—0 |
| | Acid water, brg. Rating | 1 maximum | 0—1 |
| Water Separability | | | |
| ASTMD 1401 | Demulsibility @ 82° C. Mins to break | 30 max | 10 |
| ASTM D2711 | Demulsibility Total water, ml | >40 | 41.7 |
| Anti-Wear/Extreme Pressure | | | |
| ASTM D51354 | FZG Fail Stage | 12 minimum | 13 |
| Environmental Concerns | | | |
| | Zinc-Free | Yes | Yes |
| | Ashless | Yes | Yes |
| Rig Tests for Deposit Control and Lube Life | | | |
| Bearing Rig Test (BRT) | | | |
| proprietary | Average rating (10 = clean) | >6 | 7.28 |
| | % change KV @ 40 | <8% | 2.2% |

TABLE 5-continued

| Test Method | General Description | Desired Value | Results |
|---|---|---|---|
| | Sludge rating (10 = clean) | >9 | 9.61 |
| Property Retention Test @ 70° C. (PRT) | | | |
| proprietary | Hours to filter 5 | >2000 | 2000+ |
| | Filter rating 2000 hours | >5 | 8.6 |

What is claimed is:

1. A lubricant composition comprising:

(a) a lubricating oil basestock;

(b) an effective amount of an ashless dispersant selected from the group consisting of the reaction product of a polyalkenyl succinic anhydride and a polyamine, and said reaction product post cured with cyclic carbonate, boric acid or boric acid derivative;

(c) an effective amount of an ashless rust inhibitor comprising a mixture of an alkyl succinic anhydride and an aromatic oxime; and (d) an effective amount of a polyoxyalkylene alcohol demulsifier.

2. The composition of claim 1 wherein the alkenyl group of the polyalkenyl succinic anhydride is selected from the group consisting of ethylene, propylene, butylene, isobutylene and pentene and wherein the polyamine is selected from the group consisting of ethylene diamine, diethylene triamine, triethylenetetramine and tetraethylenepentamine.

3. The composition of claim 1 wherein the alkyl succinic anhydride is represented by the formula

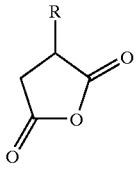

where R is an alkyl group of from about 5 to about 20 carbon atoms and wherein the aromatic oxime is represented by the formula

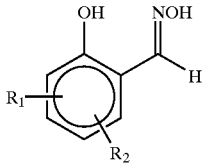

where $R_1$ is H or

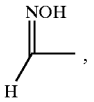

and $R_2$ is an alkyl group of from about 5 to about 15 carbon atoms.

4. The composition of claim 1 wherein the polyoxyalkylene alcohol is represented by the formula

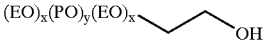

where EO is an ethylene oxide moiety, PO an propylene oxide moiety and x and y represent the relative amounts of each.

5. The composition of claim 3 and 4 wherein the polyalkenyl succinic anhydride is a polyisobutylene succinic anhydride having a polyisobutylene group with a Mn of from about 500 to about 2500 and wherein the polyamine is tetraethylene pentamine.

6. The composition of claim 5 wherein the molar ratio of alkenyl succinic anhydride to aromatic oxime is in the range of about 1:1 to about 10:1.

7. The composition of claim 6 wherein the polyoxyalkene alcohol has a molecular weight in the range of about 1700 to 3000 Mn and an EO/PO ratio of about 20:80 to about 1:99.

8. A lubricant composition comprising:

(a) a lubricating oil basestock;

(b) from about 0.1 to about 5.0 wt % of an ashless dispersant selected from the group consisting of the reaction product of a polyalkenyl succinic anhydride and a polyamine, and said reaction post cured with cyclic carbonate, boric acid or boric acid derivative;

c) from about 0.4 to about 3.0 wt % of an ashless rust inhibitor comprising a mixture of an alkylsuccinic anhydride and an aromatic oxime in the molar ratio of about 1:1 to about 10:1; and (d) about 0.001 to about 0.1 wt % of a polyoxyalkylene alcohol demulsifier, the wt % of each component being based on the total weight of the composition.

9. A circulating oil composition comprising:

(a) a basestock selected from API Group I basestocks and mixtures thereof;

(b) an effective amount of an ashless dispersant consisting essentially of the boric acid post cured reaction product of polyisobutylene succinic anhydride and tetraethylene pentamine;

(c) an effective amount of an ashless rust inhibitor comprising a mixture of an alkyl succinic anhydride wherein the alkyl group is a branched alkyl group of form 12 to 14 carbon atoms and an aromatic oxime represented by the formula

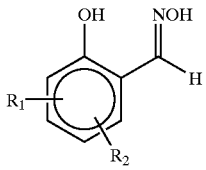

where $R_1$ is H or

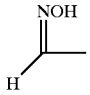

and $R_2$ is an alkyl group of 5 to 15 carbon atoms; and (d) an effective amount of a polyoxyalkene alcohol having the formula

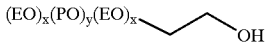

where EO is an ethylene oxide moiety, PO is a propylene oxide moiety, x and y represent the relative amounts of each moiety.

10. The composition of claim 9 including an effective amount of at least one additive selected from the group consisting of antiwear agents, metal passivators, oxidation inhibitors and anti foam agents.

11. The composition of claim 9 wherein the basestock is selected from the group consisting of API Group I, Group II, Group III, Group IV basestocks and mixtures thereof.

12. The composition of claim 11 including an effective amount of at least one additive selected from the group consisting of antiwear agents, metal passivators, oxidation inhibitors and anti foam agents.

* * * * *